United States Patent [19]

Shim

[11] 4,264,436

[45] Apr. 28, 1981

[54] METHOD OF REMOVING SOLUBLE METAL SALTS IN USED TURBINE/CIRCULATING OIL

[75] Inventor: Joosup Shim, Wenonah, N.J.

[73] Assignee: Mobil Oil Corporation, New York, N.Y.

[21] Appl. No.: 121,936

[22] Filed: Feb. 15, 1980

[51] Int. Cl.[3] ..... C01M 11/00

[52] U.S. Cl. ..... 208/180; 252/50; 210/729

[58] Field of Search ..... 208/180; 252/50, 49.9, 252/49.7; 210/54

[56] References Cited

U.S. PATENT DOCUMENTS

| | | | |
|---|---|---|---|
| 2,568,583 | 9/1951 | Graves | 208/180 |
| 3,305,478 | 2/1967 | Gilson | 208/180 |
| 4,060,491 | 11/1977 | Bridger | 252/50 |
| 4,144,180 | 3/1979 | Andress | 252/50 |
| 4,197,210 | 4/1980 | Bridger | 252/50 |

FOREIGN PATENT DOCUMENTS

| | | | |
|---|---|---|---|
| 51-12801 | 1/1976 | Japan | 208/180 |
| 51-73005 | 6/1976 | Japan | 208/180 |
| 986068 | 3/1965 | United Kingdom | 252/50 |

*Primary Examiner*—Brian E. Hearn

*Attorney, Agent, or Firm*—Charles A. Huggett; Michael G. Gilman; James D. Tierney

[57] ABSTRACT

Soluble metal salts in used turbine/circulating oils are removed by treating the used oil with soluble triazole compounds and thereafter filtering or centrifuging said oil.

9 Claims, No Drawings

METHOD OF REMOVING SOLUBLE METAL SALTS IN USED TURBINE/CIRCULATING OIL

BACKGROUND OF THE INVENTION

1. Field of the Invention

This invention relates to the reclamation or reconditioning of used lubricating oils, e.g., used turbine and/or circulating oils. More specifically, it relates to a process or method wherein soluble metal salts present in such used oils are removed economically and efficiently as sediments thereby retarding the deterioration and sludge formation of the oils.

2. Description of Prior Art

The oxidation of turbine/circulating oils in the presence of metals can often result in the formation of soluble metal salts. Used turbine/circulating oils therefore usually contain soluble metal salts which act as oxidation catalysts to accelerate oil deterioration. Thus, removal of these catalytically active metal salts retards the deterioration and sludge formation of the oils, thereby providing longer service life. However, it is difficult to remove such salts even with ultrafine filtration or ultracentrifugation. Oil users, accordingly, make little or no attempt to remove them because as stated supra no simple method is available. The novel method that we have developed has demonstrated that removal can be achieved easily and economically. Also, conceptually, this novel method can be utilized in the rerefining of waste lubricating oils and also in removing undesirable metal salts in commercial processes of catalytically cracking hydrocarbon feeds. Nevertheless, the present invention is particularly directed to the reclamation of used turbine and/or circulating oils by eliminating soluble metal salts produced from oil deterioration (oxidation).

SUMMARY OF THE INVENTION

In accordance with the present invention there is provided a method for reclaiming used turbine and/or circulating oils.

The process of the present invention comprises mixing the used turbine oil with a soluble triazole or mixture of soluble triazoles under suitable conditions of temperature and thereafter separating the resultant sediments from said used oil.

DESCRIPTION OF SPECIFIC EMBODIMENTS

The hydrocarbyl lubricating oil stock which may be treated in accordance with the present invention includes mineral oils or fractions of mineral oils, synthetic oils and mixtures of mineral and synthetic oils. The synthetic hydrocarbon oils include long chain alkanes such as cetanes and olefin polymers such as trimers and tetramers of octene and decene. The synthetic oils with which these can be mixed include (1) ester oils such as pentaerythritol esters of monocarboxylic acids having 2 to 20 carbon atoms, (2) polyglycol ethers, (3) polyacetals and (4) siloxane fluids. Especially useful among the synthetic esters are those made from polycarboxylic acids and monohydric alcohols. More preferred are the ester fluids made from pentaerythritol, or mixtures thereof with di- and tripentaerythritol, and an aliphatic monocarboxylic acid containing from 1 to 20 carbon atoms, or mixtures of such acids. The mineral oils generally include any high boiling range material, such as those boilng above 600° F.

Any suitable triazole compound may be used in the process of this invention provided it is soluble. Suitable triazole compounds include benzotriazole, alkylbenzotriazoles having from 4 to 36 carbon atoms, tolyl triazole, alkyl derivatives of tolyl triazoles having from 4 to 36 carbon atoms, and dimercapto thiadiazoles.

The operating parameters in the present process are maintained for such time as required to achieve optimum sedimentation thereby providing optimum upgrading or restoration of the quality of the oil stock. The mixing temperature of the oil and the triazoles is generally maintained within the range of about 70° to about 180° F., with a preferred range of from about 120° to about 140° F.

As noted above any suitable mixing time may be used which will give the desired degree of sedimentation.

The soluble triazoles in accordance herewith are used in small or minor amounts of from about 0.001 to about 1.0 wt. % by weight of the oil stock with a preferable range of from about 0.025 to about 0.075 wt. %. Additionally the triazoles in accordance herewith are not detrimental to any additives normally present in the used oil.

The following specific examples which are in no way limiting are presented to more fully illustrate the present invention. The data given in Table 1 was obtained by spectrographic analysis and the data of Table 2 was derived via a B-10 Oxidation Test, which outline is given below.

Example 1 is a used turbine oil sample having the following general description:

| | |
|---|---|
| Neutralization No. | 0.5 |
| Viscosity, cSt @ 40° C. | 29.8 |
| ASTM Color | 5.0 |
| Metal Content, ppm | |
| Copper | 10 |
| Iron | 21 |
| Lead | 9 |

which did not contain a triazole compound.

Example 2 was the same turbine oil sample as Example 1 containing 0.05 wt. % of a triazole compound, an isomeric mixture of 1- and 2-(didodecylaminomethyl) benzotriazole.

Example 3 was the same turbine oil sample as Example 1 containing 0.05 wt. % of another triazole compound, a reaction product of a commercially obtained tertiary-alkyl primary amine and tolyl triazole. The exact carbon number of the alkyl substitutent is not revealed but is believed to be a lower alkyl moiety.

Table 1 summarizes the comparative filtration and centrifugation data for the three Examples: used turbine oil without triazole (Example 1) and two used turbine oil with 0.05 percent each of a different triazole (Examples 2 and 3). Table 2 represents metal contents by emission spectrograph analysis, showing the depletion of metals in the used turbine oil. Table 3 gives B-10 oxidation data on reconditioned turbine oils, showing our reconditioning method hinders formation of sludges.

The B-10 oxidation test composition was subjected to a stream of air which bubbled through the composition at a rate of 5 liters per hour at 260° F. for 40 hours. Contrary to normal procedure no metal catalysts were present in the composition. The compositions were rated on the basis of oxidative stability or prevention of oil deterioration as measured by the increase in acid formation or neutralization number (NN) and sludge formation occasioned by oxidation.

TABLE 1

COMPARATIVE FILTRATION AND CENTRIFUGATION DATA

| | Example 1* | Example 2* | Example 3* |
|---|---|---|---|
| Used turbine oil | 100 | 99.95 | 99.95 |
| Mixture of 1 and 2-(didodecyl-aminomethyl) benzotriazole | — | 0.05 | — |
| Reaction product of a tertiary-alkyl primary amine and tolyl triazole | — | — | 0.05 |
| Filterability, mg/100 ml @ 8:0 membrane | 4.1 | 61.0 | 43.4 |
| Centrifugation, ml/100 ml | Trace | 1.0 | 0.6 |

*Wt. %

TABLE 3

COMPARATIVE OXIDATION STABILITY DATA

| | Example 1 | Example 2 | Example 3 |
|---|---|---|---|
| Used turbine oil | 99.75 | | |
| Filtrate from Example 2 in Table 1 | | 99.75 | |
| Filtrate from Example 3 in Table 1 | | | 99.75 |
| DBPC* | 0.25 | 0.25 | 0.25 |
| B-10 (260° F., 80 hr., no metal catalyst) | | | |
| NN Increase | 0.4 | 0.2 | 0.3 |
| Visual Sludge | Mod/Heavy | Nil | Nil |

*2,6-di-tertiary-butyl-p-cresol

It is evident from the data of Tables 1, 2 and 3 that the reclaimed used turbine oil is suitable for reuse for a variety of purposes.

While this invention has been described with reference to preferred compositions and components therefor, it will be understood by those skilled in the art that departure from the preferred embodiments can be effectively made and are within the scope of the specification.

I claim:

1. A process for forming a stabilized lubricant composition having improved resistance to oxidation and sludge formation upon exposure to an oxidative environment comprising (a) treating a used hydrocarbyl lubricant oil stock containing soluble metal salts with a soluble triazole compound in an amount from about 0.001 to about 1.0 wt. % based on the weight of the oil stock at temperatures of from about 70° to about 180° F. and (b) separating the sediments formed thereby from said oil stock.

2. The process of claim 1 wherein the used oil stock is contacted or mixed with said triazole in an amount from about 0.025 to 0.075 wt. %.

3. The process of claim 2 wherein the triazole is present in amount of 0.05 wt. %, the mixing temperature is about 140° F. and the triazole compound is selected from a mixture of 1- and 2-(didodecylaminomethyl) benzoltriazole and the reaction product of a tertiary-alkyl primary amine and tolyl triazole.

4. The process of claims 1 or 3 wherein said triazole is a mixture of 1- and 2-(didodecylaminomethyl) benzotriazole.

5. The process of claims 1 to 3 wherein said triazole is the reaction product of a tertiary-alkyl primary amine and tolyl triazole.

6. The process of claims 1 or 3 wherein the hydrocarbyl lubricant oil stock is selected from mineral oils, fractions thereof, synthetic oils and mixtures of mineral and synthetic oils.

7. The process of claim 6 wherein said lubricant oil stock is a mineral oil.

8. The process of claim 7 wherein said triazole is a mixture of 1- and 2-(didodecylaminomethyl) benzotriazole.

9. The process of claim 7 wherein said triazole is the reaction product of a tertiary-alkyl primary amine and tolyl triazole.

* * * * *

UNITED STATES PATENT AND TRADEMARK OFFICE

CERTIFICATE OF CORRECTION

PATENT NO. : 4,264,436

DATED : April 28, 1981

INVENTOR(S) : JOOSUP SHIM

It is certified that error appears in the above—identified patent and that said Letters Patent is hereby corrected as shown below:

Col. 2, line 26, "Table 1" should read -- Table 2 --.

Col. 2, line 26, "Table 2" should read -- Table 3 --.

Col. 3, line 19, Table 2 has been omitted from the patent. An Amendment Under 37 C.F.R. 1.312 was mailed to the Patent Office on March 24, 1981 incorporating Table 2 as Page 6a.

Col. 4, line 26, "1 to 3" should read -- 1 or 3 --.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*